US009749750B2

(12) United States Patent
Kuksenkov et al.

(10) Patent No.: US 9,749,750 B2
(45) Date of Patent: Aug. 29, 2017

(54) CROSS-CANCELLATION OF AUDIO SIGNALS IN A STEREO FLAT PANEL SPEAKER

(71) Applicant: CORNING INCORPORATED, Corning, NY (US)

(72) Inventors: Dmitri Vladislavovich Kuksenkov, Elmira, NY (US); Dragan Pikula, Horseheads, NY (US); Guangxin Tang, Painted Post, NY (US)

(73) Assignee: CORNING INCORPORATED, Corning, NY (US)

( * ) Notice: Subject to any disclaimer, the term of this patent is extended or adjusted under 35 U.S.C. 154(b) by 0 days.

(21) Appl. No.: 15/322,528

(22) PCT Filed: Jun. 30, 2015

(86) PCT No.: PCT/US2015/038423

§ 371 (c)(1),
(2) Date: Dec. 28, 2016

(87) PCT Pub. No.: WO2016/003962

PCT Pub. Date: Jan. 7, 2016

(65) Prior Publication Data

US 2017/0134860 A1 May 11, 2017

Related U.S. Application Data

(60) Provisional application No. 62/019,585, filed on Jul. 1, 2014.

(51) Int. Cl.
*H04S 7/00* (2006.01)
*H04R 1/02* (2006.01)
(Continued)

(52) U.S. Cl.
CPC ..... *H04R 7/045* (2013.01); *H04R 3/04* (2013.01); *H04R 5/02* (2013.01); *H04R 29/001* (2013.01);
(Continued)

(58) Field of Classification Search
CPC .. H04R 2499/15; H04R 1/2896; H04R 1/323; H04R 2420/07; H04R 2440/05;
(Continued)

(56) References Cited

U.S. PATENT DOCUMENTS 6,720,708 B2 4/2004 Athanas
7,038,356 B2 5/2006 Athanas
(Continued)

FOREIGN PATENT DOCUMENTS

EP 847670 3/1999
EP 1385354 1/2004
(Continued)

OTHER PUBLICATIONS

B. Pueo, J. J. López , G. Ramos, J. Escolano, "Efficient equalization of multi-exciter distributed mode loudspeakers", Applied Acoustics, v. 70, pp. 737-746, 2009.
(Continued)

*Primary Examiner* — Rasha Al Aubaidi

(57) ABSTRACT

A method of minimizing edge reflections of vibrational waves in a flat panel speaker assembly for a stereo device by characterizing the impulse response of the flat panel and associated components in response to a test signal to produce a cancellation signal, and applying the cancellation signal for each stereo channel to the opposing stereo channel.

13 Claims, 5 Drawing Sheets

(51) Int. Cl.

| | |
|---|---|
| ***H04R 7/04*** | (2006.01) |
| ***H04R 5/02*** | (2006.01) |
| ***H04R 3/04*** | (2006.01) |
| ***H04R 29/00*** | (2006.01) |

(52) U.S. Cl.
CPC .... *H04R 2201/403* (2013.01); *H04R 2440/05* (2013.01)

(58) Field of Classification Search
CPC H04R 2499/11; H04R 2499/13; H04R 7/045; H04R 17/00; H04R 1/025; H04R 1/026; H04R 1/2803; H04R 1/2826; H04R 1/2869
USPC ..... 381/333, 98, 332, 162, 59, 152, 398, 17, 381/182, 300, 335, 431, 56, 58, 103, 150, 381/186, 303, 345, 354, 386, 389, 395, 381/401, 94.3, 99
See application file for complete search history.

(56) References Cited

U.S. PATENT DOCUMENTS

2009/0161879 A1 6/2009 Yanagawa
2011/0274283 A1 11/2011 Athanas

FOREIGN PATENT DOCUMENTS

| | | |
|---|---|---|
| EP | 1959714 | 8/2008 |
| JP | 2005079962 | 3/2005 |
| JP | 2007187758 | 7/2007 |
| WO | 0033612 | 6/2000 |
| WO | 0064217 | 1/2002 |
| WO | 2013171512 | 11/2013 |
| WO | 2014153252 | 9/2014 |

OTHER PUBLICATIONS

International Search Report and Written Opinion of the International Searching Authority; PCT/US2015/038423; Mailed Sep. 16, 2015; 13 Pages; European Patent Office.
Patent Cooperation Treaty International Notification of Transmittal of the International Preliminary Report of Patentability Report on Patentability (Chapter I of the Patent Cooperation Treaty) of the International Searching Authority, international application No. PCT/US2015/038423: mailing date Jan. 12, 2017, 10 pages.

CROSS-CANCELLATION OF AUDIO SIGNALS IN A STEREO FLAT PANEL SPEAKER

CROSS-REFERENCE TO RELATED APPLICATIONS

This application claims the benefit of priority under 35 U.S.C. §365 of International Patent Application Serial No. PCT/US15/38423 filed on Jun. 30, 2015 which also claims the benefit of priority under 35 U.S.C. §119 of U.S. Provisional Application Ser. No. 62/019,585 filed on Jul. 1, 2014, the content of which are relied upon and incorporated herein by reference in their entirety.

FIELD

The present invention relates generally to audio speakers, and in particular to stereo reproduction in speakers comprising a flat-panel diaphragm.

TECHNICAL BACKGROUND

Flat panel speakers have been used in a variety of applications, including wall mounted units. Of particular interest are flat panel speakers that are incorporated into visual displays, such as computers and televisions, wherein the vibrating member, or diaphragm, comprises an optically clear cover positioned over the display. In some instances a glass substrate comprising the display panel itself may form the vibrating member. In either case, the reproduction of stereo sound from a single vibrating member can be particularly challenging.

SUMMARY

In one aspect, a method of reducing reflection in a flat-panel speaker is disclosed comprising delivering a first signal to a first transducer, the first transducer coupled to a panel, such as a glass substrate, adjacent to a first edge of the panel, the first transducer producing a first vibrational wave in the panel that propagates through the panel; measuring at least one characteristic of the panel at a preselected point to obtain a first panel response h1 to the first signal; delivering a second signal to a second transducer coupled to the panel adjacent to a second edge of the panel, the second transducer producing a second vibrational wave in the panel that propagates through the panel; measuring the at least one characteristic of the panel at the preselected point to obtain a second panel response h2 to the second signal; calculating a correction signal that when convolved with the second panel response and added to the first panel response substantially reduces ringing; and convolving the correction signal with a first waveform applied to the first transducer and adding the result to a second waveform applied to the second transducer. The preselected point may be, for example, adjacent to the first edge.

In some embodiments the first signal may be a maximum length sequence signal or a log chirp signal. The first signal may comprise frequencies in a range from about 20 Hz to about 20 kHz. The first signal may be delivered to a plurality of first transducers arranged in a linear array. Similarly, the second signal may be delivered to a plurality of second transducers arranged in a linear array.

The correction signal can be calculated by nulling an initial spike in the first impulse response, inverting the result and de-convolving the inverted result with the second impulse response.

In certain embodiments the correction signal is calculated using a numerical optimization that minimizes the amplitude of the signal produced by convolving the correction signal with the second impulse response and adding to the first impulse response after a predetermined time interval, where the predetermined time interval is equal to or greater than the propagation time between the first and second panel edges for a preselected frequency.

In some embodiments the correction signal is calculated using a numerical optimization where, after convolving the correction signal with the second impulse response and adding to the first impulse response, the result is filtered separately with at least two band-pass filters with non-overlapping pass bands, and wherein the numerical optimization simultaneously minimizes the amplitude of the resulting signals for each frequency band only within respective time windows where a first reflection from the first panel edge arrives.

The first and second impulse responses can be measured at a plurality of points on the panel. For example, the plurality of points may be adjacent to the first edge.

In some embodiments the correction signal is calculated by smoothing the frequency spectrum of the first impulse response and finding a signal that, when convolved with the second impulse response and added to the first impulse response produces the smoothed frequency spectrum.

It is to be understood that both the foregoing general description and the following detailed description present embodiments of the present disclosure, and are intended to provide an overview or framework for understanding the nature and character of the embodiments claimed. The accompanying drawings are included to provide a further understanding of the invention, and are incorporated into and constitute a part of this specification. The drawings illustrate various embodiments of the present disclosure, and together with the description serve to explain the principles and operations thereof.

DETAILED DESCRIPTION

Figure 1:
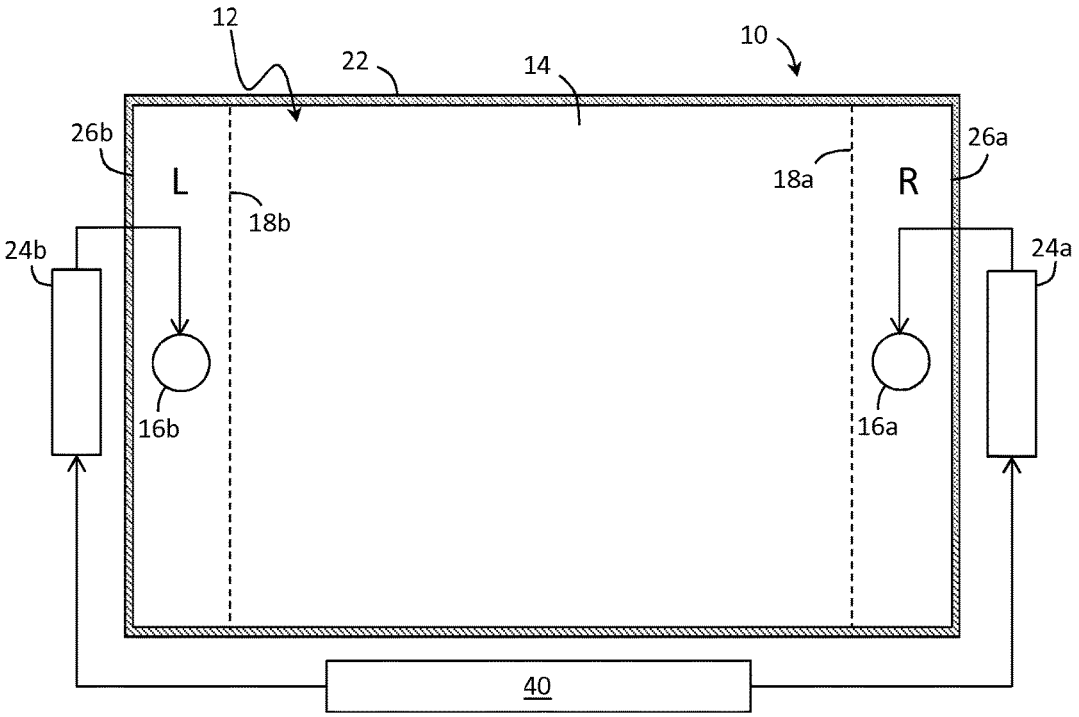
FIG. 1 is a top view of a display device comprising a panel and acoustic transducers.

FIG. 1 illustrates an example display device 10 comprising flat panel speaker 12. Flat panel speaker 12 comprises a flat substrate 14 and two or more transducers 16*a*, 16*b* configured to vibrate in response to a received electrical signal. Flat substrate 14 may be, for example, a flat glass substrate, although other substrate materials may also be employed, such as ceramic substrates, glass-ceramic substrates, polymer substrates or composite or laminated substrates. For the purpose of description and not limitation, a glass substrate will be assumed hereinafter.

Figure 2:
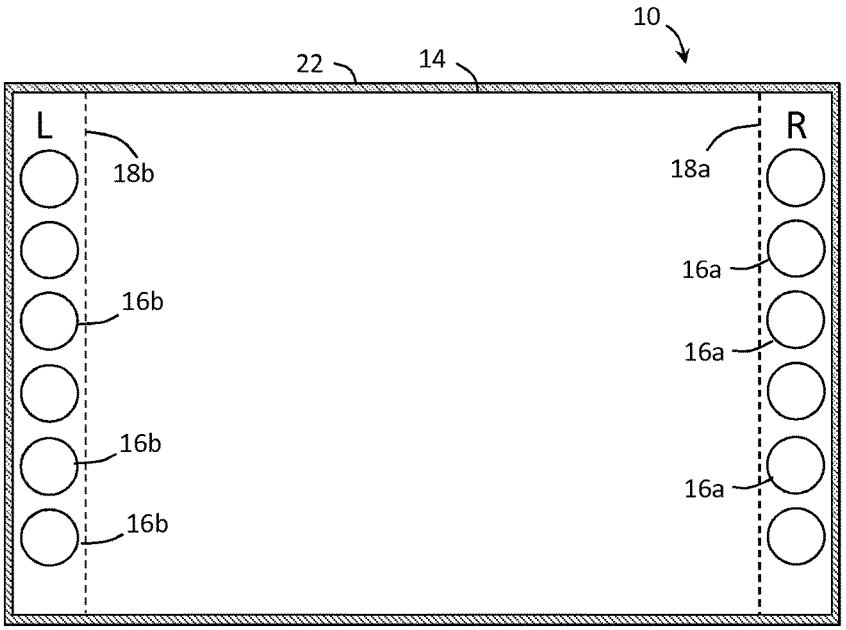
FIG. 2 is a top view of another display device comprising a panel and a plurality of acoustic transducers arranged as several linear arrays at edge portions of the panel.
Figure 4:
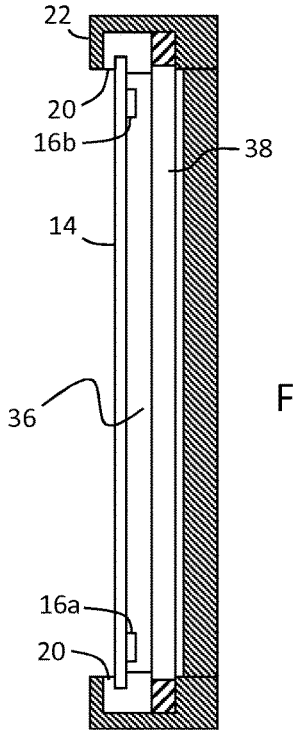
FIG. 4 is a cross sectional edge view of the display device of FIG. 1 or 2.

The at least two transducers 16*a* and 16*b* are coupled to glass substrate 14 at right (R) and left (L) edge portions 18*a*, 18*b* of the glass substrate such that when caused to vibrate by receiving an input electrical signal, vibration of the transducers is transferred to the glass substrate as a vibrational wave, which, in propagating through the glass, displaces air and creates an acoustic wave that propagates through the air. Glass substrate 14 may in turn be coupled to display device 10 by resilient mounting members 20 (see FIG. 4) which may serve to dampen the transfer of vibrational energy from glass substrate 14 to frame 22 supporting glass substrate 14 as well as dampen the reflection of vibrations incident at edges of the glass substrate. In the flat panel speaker of FIG. 1, first transducer 16*a* of the at least two transducers receives a first electrical input signal from transducer driver circuit 24*a* and second transducer 16*b* receives a second electrical signal from second transducer driver circuit 24*b*. The first electrical signal and the second electrical signal may be different electrical signals so that the vibrational wave produced by first transducer 16*a* in glass substrate 14 is different from the vibrational wave produced by second transducer 16*b*. Accordingly, glass substrate 14 may be used to produce stereo sound, wherein each of the first and second transducers 16*a*, 16*b* produce vibrational waves representing different "channels", e.g. right and left channels. In some embodiments, each edge portion of the glass substrate 14 may have a plurality of transducers coupled thereto, as shown in FIG. 2, the transducers arranged in respective arrays, such as a linear array parallel with an adjacent edge. When provided with an identical in-phase input signal, the movement of the glass substrate produced by such linearly arranged point sources can approximate a linear wave front that propagates through the glass substrate and which displaces air and creates sound. For simplicity of description and not limitation, the following discussion will be presented using only a single transducer at each edge portion of the glass substrate.

Figure 3:
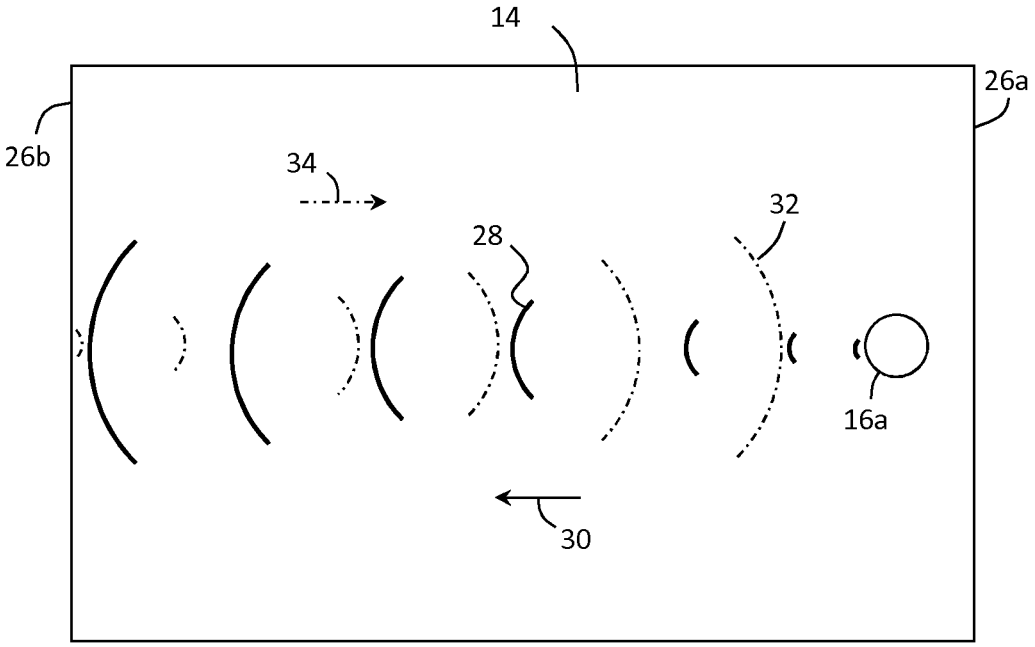
FIG. 3 is a top view of a panel showing a single transducer that produces a vibrational wave in the panel that is reflected from an opposite edge of the panel.

It should be apparent from the preceding, and referencing FIG. 3, that vibrational waves 28 propagating from the right transducer 16*a* may propagate across the glass substrate in direction 30 to second (left) edge 26*b* and be reflected backward as vibrational wave 30 toward first (right) edge 26*a*. The reflected vibrational wave may be again reflected from first edge 26*a* in direction 30 toward second edge 26*b*. Thus, the original vibrational wave 28 produced by first transducer 16*a* may be alternately reflected from second edge 16*b* and first edge 16*a* multiple times. This back-and-forth propagation of the vibrational wave can produce ringing, or a persistence in the sound produced by the glass substrate, even after the original input signal to transducer 16*a* has ceased.

Accordingly, to minimize ringing, cross-cancellation signals may be sent to the respective opposite transducers. These cross-cancellation signals produce a cancelling signal in the corresponding opposite transducer to cancel the right channel wave reflected from the left edge, and vice versa. This cross-cancellation distinguishes the present design from so-called distributed mode loudspeakers (DML), and gives embodiments disclosed herein distinct advantages. For example, since the propagation of reflected waves is minimized, the glass substrate behaves essentially as an infinite panel, with no modes and corresponding modal resonances formed, which produces a flatter frequency response than would occur in the absence of the cross-cancellation signals.

A simple delayed and inverted replica of the original signal is insufficient to create an accurate cross-cancellation signal. First, any signal provided to the transducers is modified by the transducer response, depending on the electrical impedance of the transducer and the mechanical impedance of the glass panel. Additionally, any signal is modified by the glass substrate response. Vibrational waves in glass are highly dispersive. Thus, high frequencies propagate faster than low frequencies and high frequency vibrations will reach the opposite edge of the glass substrate before the lower frequency vibrations. In addition, mechanical resonances may be present, such as so-called "box" resonances caused by air trapped in an air gap 36 (see FIG. 4) behind glass substrate 14 (e.g. between glass substrate 14 and the display panel 38). Additionally, the mass of the glass substrate will affect vibrations. Moreover, the reflectivity of the opposing glass substrate edge will generally be frequency dependent and defined by the mechanical impedance mismatch between the glass substrate and the resilient mounting members 20. Because of this frequency-dependent reflectivity, the form of the reflected wave will also not be a simple inverted replica of the incoming wave, i.e. the original signal modified by the transducer response, panel resonances and wave dispersion.

The following describes a method by which an accurate cross-cancellation signal can be created for a specific glass speaker device.

As is well known in the art, the response of a linear time invariant (LTI) system to an arbitrarily shaped signal is uniquely defined by its response to an impulse function, $\delta(t)$, the impulse response $h(t)$. For an arbitrary input signal $x(t)$, the system response $z(t)$ is a convolution of signal $x(t)$ and the impulse response $h(t)$, thus $z(t)=x(t)*h(t)$, where the operator "*" denotes convolution. Or, for a discrete system, $z[n]=x[n]*h[n]$. The problem is to find an impulse response $h(t)$ (or $h[n]$) that is the shape of the electrical signal that needs to be sent to the transducer at one edge portion of the glass substrate to exactly cancel the reflection of an impulse sent to the opposing transducer located at the opposite edge portion, and vice versa. That is, an impulse response $h_b(t)$ to be provided to transducer 16*b* must be found that will cancel the vibrational wave reflected from edge 26*b* due to a signal originating from transducer 16*a*. Assuming symmetry, a method to find only a single cancellation signal is presented. If the system is not symmetric, the procedure can be repeated to find an accurate cancellation signal for the opposing channel.

Figure 5:
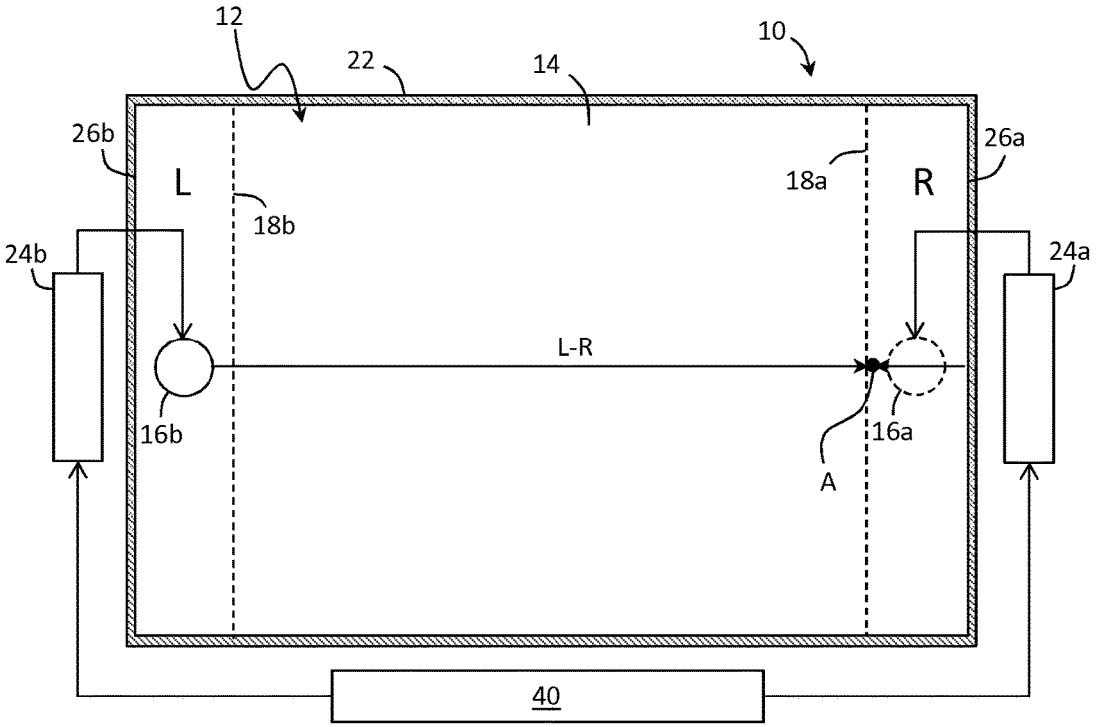
FIG. 5 is a top view of a panel showing a single transducer at the left hand short edge of a panel that produces a vibrational wave in the panel that is reflected from an opposite right short edge of the panel to develop a L-R response at an arbitrary point A.

To find the equivalent impulse response $h_b(t)$, the Left-to-Right glass substrate impulse response is measured. Several established techniques exist in the art for measuring the impulse response of systems, and specifically for audio systems. It is generally recognized that simply sending a short electrical spike to the transducer is not optimal due to the resulting poor signal-to-noise ratio. Instead, a different signal, still containing all of the audio band frequencies (typically, 20 Hz to 20 kHz) is sent. One such signal commonly used to determine a system impulse response is a so-called maximum length sequence (MLS), essentially a pseudorandom binary sequence. Another such signal is an exponentially chirped (frequency variable) constant power signal (e.g. a log chirp). Regardless the input signal selected, a measured signal is processed to obtain the system impulse response. In accordance with the present embodiment and as best seen in FIG. 5, the selected electrical signal (MLS, log chirp, or other), is provided to the appropriate transducer, for example left transducer 16*b*, and displacement of the glass substrate in a direction orthogonal to the major surface of the glass substrate is measured at an arbitrary point A, such as the point adjacent to the opposite glass substrate edge 26*a*. In FIG. 5 the location of transducer 16*a* has been indicated with a dashed outline. It should be noted that other characteristics of the glass substrate at point A could be measured, such as velocity, strain or curvature as long as the time dependence of the characteristic was accurately captured. In addition, for the example presently described, the closer point A is to right edge 26*a*, the longer the time interval between the direct response to keep, and the reflection to cancel, making discrimination of the signals easier.

Several techniques also exist in the art to measure the mechanical displacement of objects as a function of time. Such techniques include the use of a laser range finder, or laser Doppler vibrometer, or a small, highly directional and calibrated microphone placed very close to the glass substrate surface, noting that the microphone pickup will be an averaged response for a localized area. Or, a piezo-electric pick-up type displacement sensor can be attached to the glass substrate. The established techniques mentioned above are then used to process the recorded signal and infer a Left-to-Right glass substrate response. Generally speaking, this Left-to-Right glass substrate response will consist of a fixed delay representing the propagation time across the glass substrate for the highest frequency in the signal, plus a complex frequency-dependent function that comprises the transducer response, glass substrate resonances, and dispersion. The measured response will be a sum of the wave arriving at right edge 26*a* from transducer 16*b* after traversing the substrate, and the wave after being reflected from the right edge 26*a*. The frequency-dependent reflectivity of the edge, and the phase shift incurred, are generally unknown, but as will be apparent from the following, this is not important.

Figure 6:
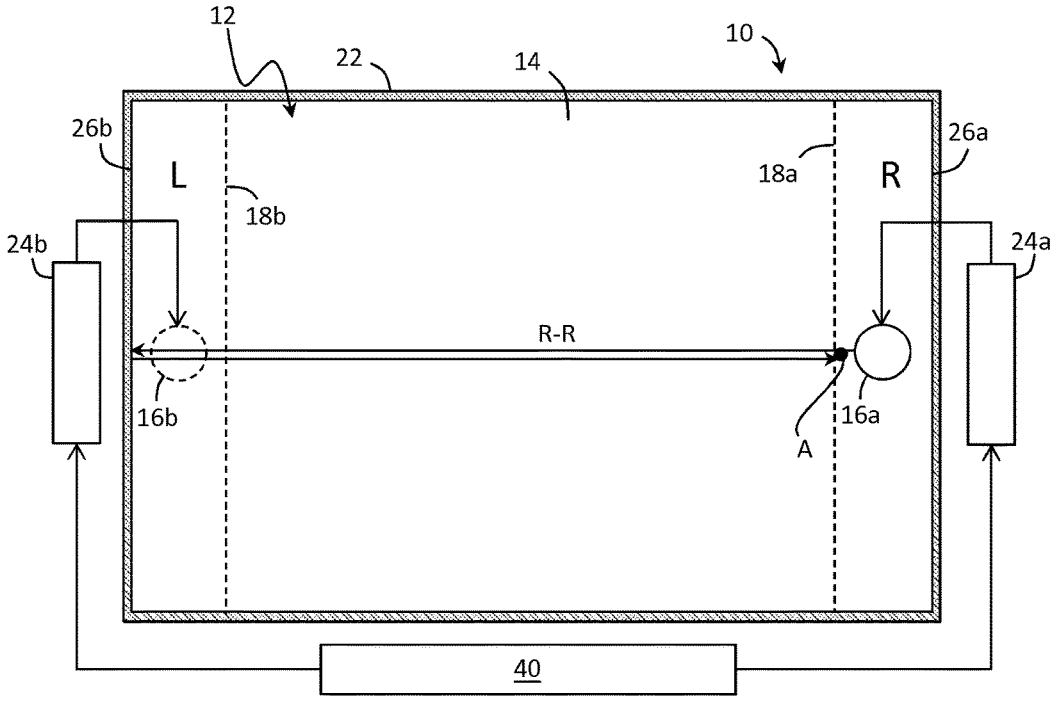
FIG. 6 is a top view of a panel showing a single transducer at the right hand short edge of a panel that produces a vibrational wave in the panel that is reflected from an opposite left short edge of the panel to develop a R-R response at the arbitrary point A of FIG. 5.

Next, and in reference to FIG. 6, the Right-to-Right panel response is measured. The previously selected electrical signal (MLS or log chirp or other) is provided to the right transducer 16*a*, and glass substrate displacement as a function of time is measured, again at the arbitrarily selected point A, and processed to yield the impulse response. In FIG. 6 the location of transducer 16*b* has been indicated with a dashed outline. Generally this Right-to-Right panel response will consist of the initial spike (direct response of the glass substrate edge to the driving impulse), and a delayed and distorted burst arriving back at point A after propagating across the substrate and being reflected from the left edge 26*b*. The Right-to-Right panel response measured at point A may also contain further "echo" signals, arriving after multiple reflections, each traverse of the glass substrate producing a progressively weaker reflected wave. The initial signal spike can be expected to be very short, shorter than a time delay equal to twice the propagation time of the highest frequency of the reflected signal arriving from the far (left) edge across the glass substrate. Therefore, the influence from the initial burst can be easily removed from the measured response by simply nulling everything measured until the arrival time of the far (left) edge reflected wave, leaving only the reflected signal arriving from the far edge, and further, weaker echo bursts.

It should be clear from the foregoing that if an appropriate cancellation signal is sent to far (left) transducer 16*b* at the correct time, no movement or only minimal movement of the glass substrate will be observed at the near (right) panel edge 26*a* after the initial "direct" spike. It should also be clear that the cancellation signal should be a measured Right-to-Right glass substrate response (with the initial short spike erased), inverted, and then de-convolved with the measured Left-to-Right glass substrate response. Sending this resultant signal to far (left) channel transducer 16*b* will result in a glass substrate displacement at the left edge 26*b* equal in amplitude and opposite in sign to the reflected wave, i.e. it will result in a cancellation of the reflected wave, and total displacement at right edge 26*a* will be exactly zero at any point in time after the initial "direct" spike.

Established numerical techniques exist in the art for de-convolution of the signals. Algorithms such as Wiener and Richardson-Lucy de-convolution for example, have been developed for various problems in signal processing, such as optical and radio-frequency signal distortion. For audio applications, de-convolution techniques have also been applied to room response correction. In theory, de-convolving the Right-to-Right glass substrate response with the Left-to-Right glass substrate response can produce an accurate cross-cancellation signal for the right stereo channel from transducer 16*a*, to be sent to the left channel transducer 16*b*. In reality, the result will not be truly exact, since both measured responses will contain noise. However, the better the signal-to-noise ratio for the measurements, the more accurate the result.

One way to improve accuracy is to take multiple measurements of the system response and average the results, which will improve the signal-to-noise ratio. Another approach is to make use of known and predictable features in the glass substrate behavior. For example, the vibrational wave velocity is proportional to the square root of frequency, so the dispersion of glass substrate 14 can be predicted with a high degree of accuracy. Alternatively, the mechanical and electrical impedance of the transducers 16*a*, 16*b*, and the mechanical impedance of the resilient mounting members 20 can be independently measured, which will allow an accurate prediction of edge reflectivity. The measurement results can be filtered to leave only the frequency components within the audio band of interest, typically in a 20 Hz to 20 kHz range. The frequency dependence of both amplitude and phase of the response can be replaced with the best fit to the data of a mathematical smoothing function of arbitrary form, for example an $n^{th}$ degree polynomial, or based on known physics of the glass substrate, thereby removing random fluctuations.

It should also be understood that techniques for measuring impulse response, such as MLS or log chirp, are based on the assumption that the system under test, as assumed here, is linear and time-invariant, whereas real systems, including the glass speaker described herein, are neither. Techniques exist in the art to analyze and correct the measured impulse responses for at least some types of nonlinear distortion. Still, after the appropriate cross-cancellation signals are determined, the acoustic response of the glass substrate should be measured and analyzed, both in the frequency domain and in the time domain. If an anomaly is discovered at a certain frequency or in a narrow frequency range, a direct measurement at that frequency can be performed. Using a dual-channel function generator, sinusoidal signals with variable amplitude ratios and variable phase differences can be sent to the right and left channel transducers 16*a*, 16*b*, and the variable parameters adjusted until cancellation at that frequency is achieved. The signals used might be a continuous single frequency, or short bursts of sinusoidal signals, to enable easier observation of reflections. It should in principle be possible to reconstruct the entire impulse response in question frequency-by-frequency. One may also take the impulse response produced by de-convolution as an initial guess, and adjust it, point-by-point, in real time, while observing the Right-to-Right panel response, until no first reflection is seen arriving from the opposite glass substrate edge after an initial direct burst. However, such procedures would be significantly more time consuming than the de-convolution technique described above.

After the appropriate impulse response for accurate Left-to-Right reflection cancellation is found for an arbitrary waveform sent to the right stereo channel transducer 16*a*, the corresponding cross-cancellation waveform signal to send to the left channel transducer 16*b* is a convolution of that impulse response with the right channel waveform. For digital electronics, such convolution can be performed by implementing a finite impulse response (FIR) filter in audio controller 40 coupled to transducer controllers 24*a*, 24*b*, which is basically an impulse response digitized at a given sampling rate, typically 44.1, 48, 88.2, 96, or 192 kHz. Given the very strong dispersion of vibrational waves in glass, and the large size of the glass substrates that might be desirable to use as a cover glass for modern flat-panel displays, including televisions, the equivalent impulse response might be several tens of milliseconds long, and therefore the FIR filter, for example at a 96 kHz sampling rate, can be several thousands of coefficients long, requiring quite powerful digital signal processing (DSP) chips with large memory buffers to implement. While this might not be a problem at the current stage in digital electronics technology, a much more computationally efficient recursive filter known as an infinite impulse response filter (IIR) couple can be used to closely approximate the required equivalent impulse response. The techniques for IIR filter design are well known and described in multiple publications on digital signal processing. For example, an approach based on cascaded second-order IIR filters can be used.

In the instance where an array of transducers is implemented at each edge portion, the array of transducers is not a perfect implementation of a line transducer in that the vibrational wave produced in the substrate might not be perfectly cylindrical or uniform across the length of the respective edge. As a result, the waves traveling from left to right, or right to left, might not arrive at the same time and with precisely the same amplitude at the opposite panel edge. Accordingly, it may be necessary to measure the system responses, both Left-to-Right and Right-to-Right, at many points along the edge, and use all of the results in further processing.

If the propagating waves are not perfectly cylindrical, a non-negligible wave vector component may exist in a direction along the short edge (e.g. right or left) of the panel, and a correspondingly small amount of wave energy may experience at least partial reflection from the top and bottom edges of the substrate. In effect, this would cause multi-path interference, meaning there will be more than one way for the wave to travel from one edge to the other edge with different path lengths and therefore different delays depending on wave velocity. An approximate solution to multi-path interference can be developed using a digital signal processing technique known as multiple-input multiple-output (MIMO) optimization. That is, optimal equivalent impulse response functions are found independently for each individual transducer, and each transducer would be driven by an independent amplifier with the corresponding cross-cancellation signal.

In one experiment a stereo flat panel loudspeaker manufactured by Athanas Acoustic Devices was selected for testing in a series of experiments. The speaker used a 0.55 mm thick Corning® Gorilla® glass panel mounted with a 4 mm gap over a 68.6 mm (27 inch) diagonal LCD display. The glass panel was attached to the device frame using rubber strip "surrounds" on the right and left edges only, leaving the top and bottom edges free of contact with the surrounds. Two arrays of 9 exciters per array, each exciter being 36 mm diameter, were affixed to the glass with adhesive in a vertical line along both the left and right edges of the panel, and also affixed to the frame in a "grounded" design. The exciters were electrically connected in a series/parallel arrangement to present an 8 ohm impedance to the driving circuitry.

150 measurement points were marked on the right panel edge portion, over the area where the exciters were attached, in three rows of 50 points each, evenly distributed from the top edge to the bottom edge of the panel, and at slightly different distances from the extreme right edge. A single point Doppler laser vibrometer, supplied by Polytec Incorporated, was used. The vibrometer produces an output voltage proportional to the surface velocity of the measured wave at each point. Vibrational impulse responses at each point to an input signal were recorded with an CLIO 10 system from Audiomatica, using 16 k long MLS sequences, and driving first right (Right-to-Right impulse response) and then left (Left-to-Right impulse response) banks of exciters.

Figure 7:
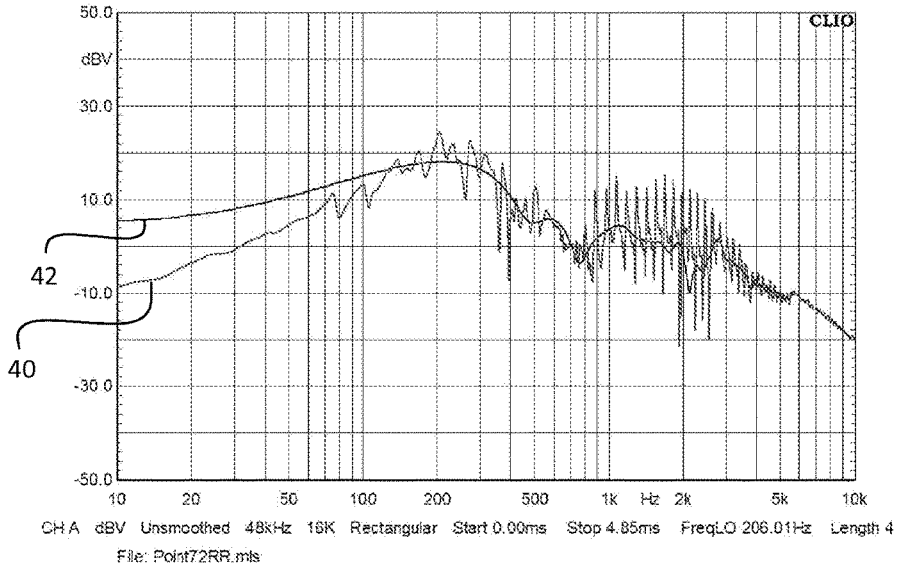
FIG. 7 is a graph of the spectra of an example Right-to-Right vibrational response.

It was observed that the first "direct" spike of the Right-to-Right responses was not exclusively comprised of the response of the drivers loaded by the mechanical impedance of glass. It can be thought of as a superposition of two vibrational waves propagating from right to left—one sent to the left by the array of exciters, and another sent to the right and reflected from the nearby right edge. FIG. 7 is a graph of the measured spectra of the typical observed Right-to-Right vibrational impulse response recorded at an arbitrary measurement point (i.e. measurement point 72). The fast "ripple" in the spectrum represented by curve 40, clearly pronounced in the 1-3 kHz range, is due to multiple reflections from the left and right panel edges. The much slower ripple, which first peaks at 200 Hz, dips at 700 Hz, peaks again at 1 kHz and so on, is a result of interference between the vibrational wave sent directly from the right array of exciters, and the slightly delayed vibrational wave reflected from the right panel edge. This is confirmed by curve 42, which illustrates the spectrum of only the initial approximately 2 millisecond long spike of the impulse response, where the fast ripple disappears but the slow one is preserved.

The slow ripple of the spectrum can be considered a part of the direct driver response, which will be present both for the impulse sent to the right channel, and for the cancellation signal sent to the left channel, and therefore a detailed knowledge of its nature is not necessary for constructing an accurate cancellation signal.

Figure 8:
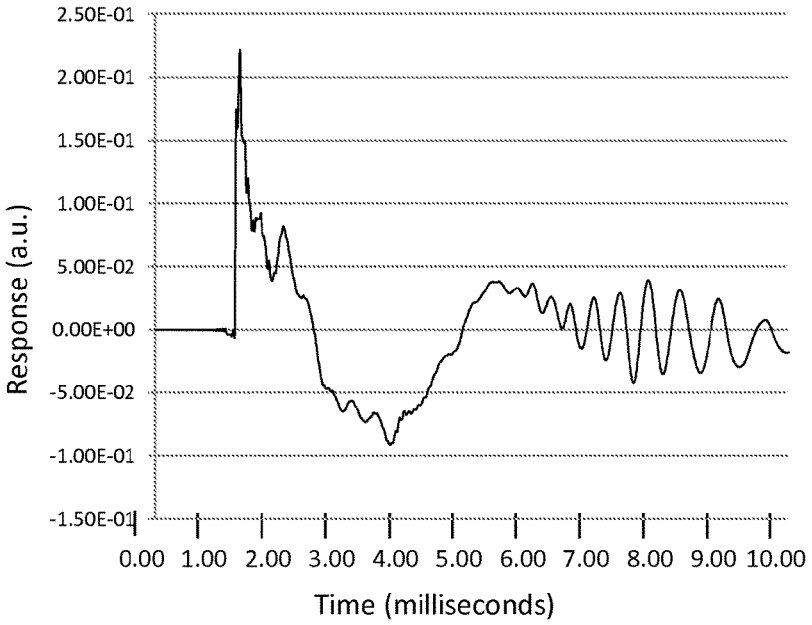
FIG. 8 is a graph of a typical first measured response spike of a Right-to-Right vibrational impulse response.

It was not possible to cleanly separate the first "direct" spike in the Right-Right response from the reflected signal arriving from the left edge. Simply speaking, for the approximately 0.6 meter long panel of the device under test, the 10 kHz bending wave takes approximately 2 milliseconds to traverse the panel, but 10 milliseconds is necessary to reproduce one period of the 100 Hz wave. FIG. 8 presents the first 10 milliseconds of the Right-Right vibrational impulse response, measured at point #72. It is clearly visible from FIG. 8 that the first weak burst of some very high frequency reflection arrives at approximately 2.9 milliseconds, while slow components of the initial spike are far from finished.

A numerical procedure was devised that determines what signal, convolved with the Left-to-Right vibrational impulse response and added to the Right-to-Right vibrational impulse response for a given measurement point, will cause the total response to have progressively lower amplitude (lower energy over the whole frequency range of interest) as a function of time. Progressively lower, for the purposes described herein, was defined as a "weight coefficient" for the vibrational energy, increasing with increasing time.

It was also observed that the responses measured at different points are more than slightly different, and not just because the noise contribution to every measurement is obviously different. De-convolution for one point is reasonably easy, and it was possible, for that one point, to create a cross-cancellation signal that would make the point dead still a few milliseconds after the initial spike begins. However, the same signal might not work at some other measurement point, and may increase the vibrational energy and the length of panel "ringing" in time. There are several physical reasons for this.

One reason is that the line of round exciters does not send a perfect cylindrical vibrational wave across the panel. According to 2D laser vibrometer maps, the wave front is slightly "wavy" instead of perfectly flat, which will cause the arrival times at the other end of the panel to also vary. Also, some small amount of reflection takes place at the unconstrained top and bottom edges of the panel. In addition, the far edge of the glass panel where it is attached to rubber surrounds is not the only reflective boundary. Adhering the voice coils of the exciters to the glass panel will cause a change in the effective mechanical impedance for the vibrational wave, and therefore reflection. Roughly speaking, the wave will be reflected three times—from the front edge of the line of exciters, from the back edge of the line of exciters, and then from the edge of glass. A more accurate picture is even more complex than that, since the front and back edges of the line of discrete, round exciters are not really straight lines. As a result of the combined effects, each point on the glass panel is truly unique, with unique Right-to-Right and Left-to-Right vibrational impulse responses. One compensation signal cannot do a perfect job for all of them.

Accordingly, the numerical routine must address the signal which, when convolved with each individual Left-to-Right response for a given number of measurement points, and added to the corresponding Right-to-Right response, will cause the total vibrational energy at all of the points together to have progressively lower amplitude over time.

It was further observed that impulse responses measured at points closer to the corners of the glass panel are typically very different from those measured in the middle of the glass panel. Even though all points theoretically produce sound waves with about the same efficiency, the final optimization trial was limited to only 90 points (3 rows of 30) in the middle of the glass panel, in the hope that the algorithm would converge more easily for a set of responses that are similar to each other. The length of the compensation signal in time was limited to 30 milliseconds. As a result, the total ringing in the panel after the first 10 milliseconds was reduced by at least a factor of three in respect to the uncompensated case. To determine the acoustic benefit of the compensation signal, a calibrated microphone was positioned approximately 1 meter away in front of the glass panel. The measured acoustic impulse responses were shortened to less than 15 milliseconds compared to greater than 50 milliseconds long for the uncompensated case. This resulted in a very audible improvement of the speaker sound quality, which was especially pronounced in the vocal range (200-2000 Hz).

It should be noted that it is not necessary to minimize vibration at all times and in the entire audible frequency range. Since the dispersion function of the glass panel (wave speed as a function of frequency) is well known from structural mechanics theory, and can be accurately measured by experiment, one can predict when the first reflection for each specific frequency arrives from the far edge, even if in reality several reflections take place at slightly different positions. A numerical routine can then be created that minimizes vibration at each measurement point (or the total for all points), and for each specific frequency, only within the time window when the first reflection for that frequency is expected to arrive. If the first reflection is minimized, the subsequent reflections will be substantially reduced.

Considering the foregoing, a numerical routine was devised that minimized prolonged ringing caused by multiple reflections by minimizing the energy in the glass beyond some pre-determined point in time. A signal was found that, when convolved with each individual Left-Right impulse response, and added to the corresponding Right-Right impulse response, causes the total vibration at all points to be minimized after a predetermined number of milliseconds. No averaging is required, since the routine seeks the final version of the signal achieving the best "compromise" for all points. The solution is not dependent on the physics of the glass panel, and just works with the set of measured signals, which can be of arbitrary nature. The length of the compensation signal can be limited to a pre-determined period of time equal to the panel traverse time for the lowest frequency of interest.

Again, an assumption is made that the system is linear. Thus, if the response h(t) to the impulse δ(t) is known, one can determine the response to an arbitrary input. If the impulse response to delta function δ(t) applied on the right side is $h_R(t)$, and the impulse response to the delta function δ(t) applied to the left side is $h_L(t)$, the total system response z(t) can be computed as $z(t)=x(t)*h_L(t)+y(t)*h_R(t)$, where x(t) and y(t) are arbitrary functions of time.

To ensure the routine works for all frequencies, the delta function is applied to the right side and y(t) is set to δ(t) and a waveform x(t) that minimizes equation (1) below is sought:

$$\min \int_0^\infty W(t)z(t)^2\,dt \tag{1}$$

where W(t) is a weight function selected to be zero at t=0 ($t_0$) and which then transitions to 1 shortly after time $t_0$, e.g. within a few milliseconds.

For the purposes described herein, W(t) was set as $(\pi/2+\arctan(a(t-t_0)))/(\pi/2)$. For easier writing, one can express:

$$L(t)=x(t)*h_L(t), \tag{2}$$

$$R(t)=y(t)*h_R(t)=h_R(t)(\text{since } y(t) \text{ was set equal to } \delta(t)), \tag{3}$$

$$\text{So, } z(t)=L(t)+R(t). \tag{4}$$

Since sampled signals within finite time are used, the foregoing analog criteria can be written in discrete nomenclature as:

$$\min\sum_{i=1}^{n}(w_i z_i^2) = \min\sum_{i=1}^{n}(w_i(L_i+R_i)^2) \tag{5}$$

To minimize the energy in the glass over at least 100 milliseconds, more than a thousand optimal values $x_i$ may be needed (a time period of about 20 to 30 milliseconds for the present example). To accomplish this, certain linear properties are used. To find L(t) such that R(t)+L(t)=0, or in discrete form:

$$L_i=-R_i \tag{6}$$

for i=1 to n. Using linearity principles, $L_i$ can be replaced as the convolution of an unknown function x and the impulse response $h_L$, $$L_i=\sum_{j=1}^{i} h_{L(i-j)}x_j \tag{7}$$

and one can arrange known $h_L$ values next to unknown x values to obtain the matrix equation:

$$HX=-R \tag{8}$$

where H denotes matrix $H(i,j)=h_{L(i-(j+1))}$ and i=1,n, j=1,m and if (i−j)<1 then H(i,j)=0.

Since the duration of the function x is limited to a short time, the number of unknown values $x_i$ (i=1 to m) comprising x is several times smaller than the number of equations n, and a solution that satisfies the equations exactly cannot be obtained. An approximation, however, can be found by minimizing the error square $(HX+R)^T(HX+R)$, where the operator "T" denotes the transpose, and thus $X=(H^TH)^{-1}(-H^TR)$.

To make use of weight function W, both sides of (6) can be multiplied by w, to obtain:

$$X=((HW)^T(HW))^{-1}(-(HW)^T(RW)). \tag{9}$$

Thus, the optimization problem previously described at (5) can be relegated to a task of solving a system of m linear equations, and by limiting the optimal solution to a time period suitable for the panel size (equal to the panel traverse time for the lowest frequency of interest., e.g. 20 to 30 milliseconds for the 27 inch diagonal panel), one can ensure the left side of the glass does not produce ringing after an initial few milliseconds long time period. It also forces a solution that cancels all reflections beyond the first one.

Since each measurement point has a slightly different response, a solution that minimizes total energy at all points is desired. This can be accomplished by adding a set of equations like equation (6) for each point. A single waveform x that is 20 to 30 milliseconds long is still sought. The number of equations increases, but the number of unknowns remains the same. Additionally, the number of rows to matrices H and R increases, but equation (9) still inverts a matrix of the same dimensions, m by m.

In another approach, straight de-convolution and averaging can be applied. For each measurement point, a signal is found that, when convolved with the Left-to-Right response and added to the Right-to-Right response, causes the total to stop (turn to zero) after a predetermined period of time within the range from the expected arrival time for the highest frequency to the expected arrival time of the lowest frequency of interest. Variation is possible when a total response is allowed to gradually decay, as opposed to a dead stop at the end of the time interval by applying a "weight" function to the response and giving progressively higher weight to the later points in time. Another variation is possible when the "stop time" for each frequency is fixed depending on the expected reflection arrival time. Then, averaging is performed to find the "average" signal for all points. The more points, the more accurate the expected result.

In still another approach, fringes, or fast oscillation in the vibrational spectrum, are caused by multiple reflections from the edges. For each measurement point a target spectrum is defined by smoothing the measured Right-to-Right response spectrum such that fringes are not present. Then, for each point a signal is found that, when convolved with the Left-to-Right response and added to the Right-to-Right response, produces that target spectrum. The signals found for all of the measurement points are averaged. Alternatively, an average of the power spectra of all the measured Right-to-Right responses is smoothed to eliminate fringes, and then a signal is found that, when convolved with each individual Left-Right response and added to the corresponding Right-Right response, will produce that average spectrum.

In still another approach, and assuming the driver array response on the left and on the right are exactly the same, the knowledge of that response is not required, since both the electrical "signal" signal and the electrical "cancellation" signal will go through the drivers. A physical model of the signal reflected from the far edge can then be created, which may consist of consecutively applied: a) a set of second order filters (low pass, high pass, or bandpass) representing the resonances of the panel; b) a fixed delay; c) an all-pass filter with flat amplitude and varying phase, representing panel dispersion, or frequency dependent delay; and d) the reflection function, which might be either a constant, equal to the ratio of mechanical impedances at the reflecting boundary, or a slowly varying function of frequency (if the mechanical impedances at the sides of the boundary do not vary the same way with frequency), which might be represented by a single first or second order filter. If there are several reflecting boundaries, then each will have to be included in the model, with different parameters for b), c), and d). The cancellation signal would be the inverse of the reflected signal. Once the model is created it will have a number of fitting parameters, the optimal values of which can be found using any of the foregoing approaches. The difference is that a limited set of fitting parameters is sought, as opposed to an arbitrarily shaped function of specified duration. An additional advantage is that the result may be more easily implemented using commercially available audio digital signal processing hardware, such as chips from Analog Devices, Inc. or Texas Instruments, Inc., which are designed for optimal implementation of first and second order filters.

Figure 9:
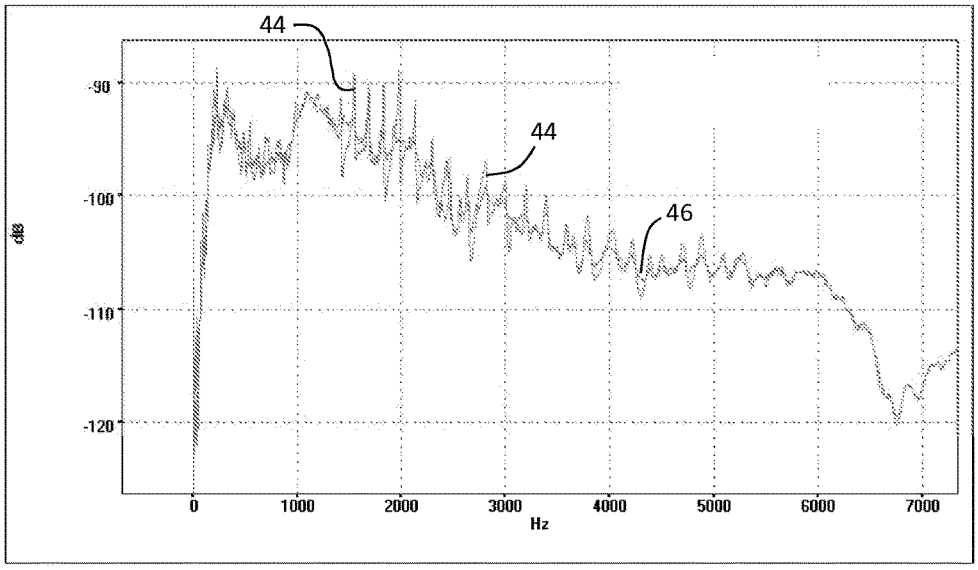
FIG. 9 is a graph of the average power spectrum for an example display device and display panel during the application of an impulse to the left channel transducers both before application of the derived cross cancellation signal to the right channel transducers and after application of the derived cross-cancellation signal to the right channel transducers.

As previously stated, one need not rely on the physical movement of the substrate panel to develop a cancellation signal, such as through the use of a vibrometer. For example, in another experiment involving the same display unit described in respect of the previous experiment above, ten points were selected on the display, five near the left edge portion of the display panel and five near the right edge portion of the display panel. Two impulse responses were measured using a calibrated microphone positioned approximately 2 cm from the surface of the substrate at each of the ten points, one impulse response driving the left array of transducers and one impulse response driving the right array of transducers. By using microphones, the impulse response is averaged over a localized area since more than just a single point on the substrate surface contributes to the displacement of air measured by the microphone. Therefore, this approach might have an advantage over using a laser vibrometer in that fewer points would be required to produce the same quality reflection cancellation signals. Data obtained from the microphones adjacent to four of the points near the left edge portion were used to find the optimal cross-cancellation signal to send to the right channel transducers (one data set obtained from one of the points was unusable and subsequently discarded), and data obtained from microphones adjacent to the five points near the right side of the substrate were used to obtain an optimal cross cancellation signal to send to the left channel transducers. FIG. 9 illustrates the average power spectrum (power in dB vs frequency in Hertz) for responses recorded at all nine of the measured points during the application of an impulse to the left channel transducers both before application of the derived cross cancellation signal to the right channel transducers (curve 44) and after application of the derived cross-cancellation signal to the right channel transducers (curve 46). As is clearly evident from the plotted curves, the application of a cross-cancellation signal derived using the acquired acoustic signals from the positioned microphones resulted in a reduction in the amount of ripple in curve 44 resulting from multiple reflections that is present in the "before" case represented by curve 46.

It will be apparent to those skilled in the art that various modifications and variations can be made to the embodiments disclosed herein without departing from the spirit and scope of the disclosure. For example, it should be apparent that the flat panel need not be a glass substrate, but could be formed of other materials, such as fiber-based board (e.g. cardboard), plastic, ceramic, metal etc. Thus, it is intended that the present disclosure cover the modifications and variations of these embodiments provided they come within the scope of the appended claims and their equivalents.

What is claimed is:

1. A method of reducing reflection in a flat-panel speaker comprising:

delivering a first signal to a first transducer, the first transducer coupled to a panel adjacent to a first edge of the panel, the first transducer producing a first vibrational wave in the panel that propagates through the panel;

measuring at least one characteristic of the panel at a preselected point to obtain a first panel impulse response h1;

delivering a second signal to a second transducer coupled to the panel adjacent to a second edge of the panel, the second transducer producing a second vibrational wave in the panel that propagates through the panel;

measuring the at least one characteristic of the panel at the preselected point to obtain a second panel impulse response h2;

calculating a correction signal that when convolved with the second panel impulse response and added to the first panel impulse response substantially reduces ringing in the result; and convolving the correction signal with a first waveform applied to the first transducer and adding the result to a second waveform applied to the second transducer.

2. The method according to claim 1, wherein the preselected point is adjacent to the first edge.

3. The method according to claim 1, wherein the first signal is a maximum length sequence signal or a log chirp signal.

4. The method according to claim 1, wherein the first signal comprises frequencies in a range from about 20 Hz to about 20 kHz.

5. The method according to claim 1, wherein the first signal is delivered to a plurality of first transducers arranged in a linear array.

6. The method according to claim 1, wherein the second signal is delivered to a plurality of second transducers arranged in a linear array.

7. The method according to claim 1, wherein the correction signal is calculated by nulling an initial spike in the first impulse response, inverting the result and de-convolving the inverted result with the second impulse response.

8. The method according to claim 1, wherein the panel is a glass substrate.

9. The method according to claim 1, wherein the correction signal is calculated using a numerical optimization that minimizes the amplitude of the signal produced by convolving the correction signal with the second impulse response and adding to the first impulse response, after a predetermined time interval, where the predetermined time interval is equal to or greater than the propagation time between the first and second panel edges for a preselected frequency.

10. The method according to claim 1, wherein the correction signal is calculated using a numerical optimization where, after convolving the correction signal with the second impulse response and adding to the first impulse response, the result is filtered separately with at least two band-pass filters with non-overlapping pass bands, and wherein the numerical optimization simultaneously minimizes the amplitude of the resulting signals for each frequency band only within respective time windows where a first reflection from the first panel edge arrives.

11. The method according to claim 1, wherein the first and second impulse responses are measured at a plurality of points.

12. The method according to claim 11, wherein the plurality of points are adjacent to the first edge.

13. The method according to claim 1, wherein the correction signal is calculated by smoothing the frequency spectrum of the first impulse response and finding a signal that, when convolved with the second impulse response and added to the first impulse response produces the smoothed frequency spectrum.

* * * * *